US006835086B1

(12) United States Patent
Tsai

(10) Patent No.: US 6,835,086 B1
(45) Date of Patent: Dec. 28, 2004

(54) MODULAR TELEPHONE PLUG

(76) Inventor: Shou-Chun Tsai, No. 30-3, Tatung St., Chiafu Village, Tantzu Hsiang, Taichung Hsien (TW)

( * ) Notice: Subject to any disclaimer, the term of this patent is extended or adjusted under 35 U.S.C. 154(b) by 0 days.

(21) Appl. No.: 10/716,482

(22) Filed: Nov. 20, 2003

(51) Int. Cl.[7] ..... H01R 13/627
(52) U.S. Cl. ..... 439/354
(58) Field of Search ..... 439/350–358, 439/676

(56) References Cited

U.S. PATENT DOCUMENTS 4,986,766 A * 1/1991 Leonard et al. ..... 439/354
5,254,014 A * 10/1993 Yagi et al. ..... 439/353
6,364,685 B1 * 4/2002 Manning ..... 439/357

* cited by examiner

*Primary Examiner*—P. Austin Bradley
*Assistant Examiner*—Felix O. Figueroa
(74) *Attorney, Agent, or Firm*—Troxell Law Office PLLC

(57) ABSTRACT

A modular telephone plug includes an elongated housing, a connector module and a flexible engaging tab. The elongated housing has an inside end, an outside end, a bottom and a coupling device formed on the bottom. The connector module is mounted in the elongated housing at the inside side. The engaging tab with two opposite detents is detachably mounted on the bottom of the elongated housing that forms a gap and has a stationary end fastened on the bottom at the inside end and a free end abutting slidably on the bottom at the outside end of the elongated housing. The detents are adjacent to the inner end. Consequently, a person can conveniently grasp the elongated housing to pull out the telephone plug and use a light force to press the engaging tab to disengage the detents from the jack hole.

2 Claims, 6 Drawing Sheets

MODULAR TELEPHONE PLUG

BACKGROUND OF THF INVENTION

1. Field of the Invention

The present invention relates to a telephone plug, and more particularly to a telephone plug for a connection of an RJ-type jack and the telephone plug has an engaging tab that is protected from being inadvertently broken.

2. Description of Related Art

Telephone cords are used to connect a telephone to either a wall terminal or its handset and typically consist of pairs of insulated copper wires, such as 2, 4 and 8 wires that are commonly arranged in twisted pairs. Generally, each end of the telephone cord fitted with a modular telephone plug to facilitate attachment to a jack hole of a socket either in the telephone or on the wall terminal.

With reference to FIG. 5, a telephone plug (50) in accordance with the prior art is inserted into a jack hole (211) of a socket (21) for a connection between a telephone cord (20) and the socket (21). The telephone plug (50) comprises a housing (501), an engaging tab (502) and a connector module (not shown). The housing (501) has an inside end (not numbered), an outside end (not numbered) and an exterior periphery (not numbered). The engaging tab (502) is formed integrally on the exterior periphery as the housing (501) is fabricated by plastic molding and has two opposite detents (503) that engage the jack hole (211) as the telephone plug (50) is inserted. The connector module, typically comprises pairs of parallel pieces of metal, is mounted in the housing (501) at the inside end. The telephone cord (20) is received and held in the outside end and connects electrically to the connector module for an electrical connection between the telephone cord (20) and the telephone.

However, the engaging tab (502) must be pressed so that the telephone plug (50) can be inserted into the jack hole (211), then the detents (503) of the engaging tab (502) engage the jack hole (211) to hold the telephone plug (50) as the engaging tab (502) is released. Since the engaging tab (502) is made of hard plastic, the engaging tab (502) usually faces a fatigue failure problem, such as the engaging tab (502) will tend to break off the housing (501) if the engaging tab (502) is repeatedly pressed and released. Furthermore, one end of the engaging tab (502) is tilted upwardly such that the engaging tab (502) is easily broken if the free end of the engaging tab (502) inadvertently hooks something. If the engaging tab (502) is broken off the housing (501), the telephone plug (50) cannot be held firmly in the jack hole (211) so that the telephone plug (50) will lose its function.

With reference to FIG. 6, another telephone plug (60) in accordance with prior art is a modification to mitigate or obviate the aforementioned problems. The conventional telephone plug (60) comprises a housing (61), an engaging tab (62) and a connector module (63). Likewise, the telephone plug (60) is adapted to be inserted into the jack hole (211) of the socket (21) as previously described. The housing (61) is elongated and has an inside end (not numbered), an outside end (not numbered) and an exterior periphery (not numbered). The engaging tab (62) is attached to the exterior periphery of the housing (61) and has a stationary end (not numbered), a free end (not numbered) and two opposite detents (611). The stationary end is fastened at the outside end of the housing (61). The free end extends toward the inside end of the housing (61) and slidably abuts on the exterior periphery. The connector module (63) is mounted in the housing (61) at the inside end and connects electrically to the telephone cord (20) that is held at the outside end.

Therefore, when the telephone plug (60) is partially inserted into the jack hole (211), the detents (611) will engage the jack hole (211) to hold the telephone plug (60) in position. If the telephone plug (60) needs to be taken out of the jack hole (211), it is necessary to press the engaging tab (611) at a position near to its free end so that the detents (611) can entirely disengage from the jack hole (211). However, to conveniently access the position near to the free end of the engaging tab (62) is not easy when the telephone plug (60) is held in the jack hole (211). Especially, when a person who often needs to wear gloves wants to press, the engaging tab (62) of the telephone plug (60), in such a situation, it is difficult to press approaching the position and quickly pull the telephone plug (60) out.

To overcome the shortcomings, the present invention provides an improved telephone plug to mitigate or obviate the aforementioned problems.

SUMMARY OF THE INVENTION

The main objective of the invention is to provide an improved telephone plug that is convenient to use and has a labor-saving engaging tab for a person to press conveniently to disengage the telephone plug from a jack hole.

Other objectives, advantages and novel features of the invention will become more apparent from the following detailed description when taken in conjunction with the accompanying drawings.

DETAILED DESCRIPTION OF PREFERRED EMBODIMENT

Figure 1:
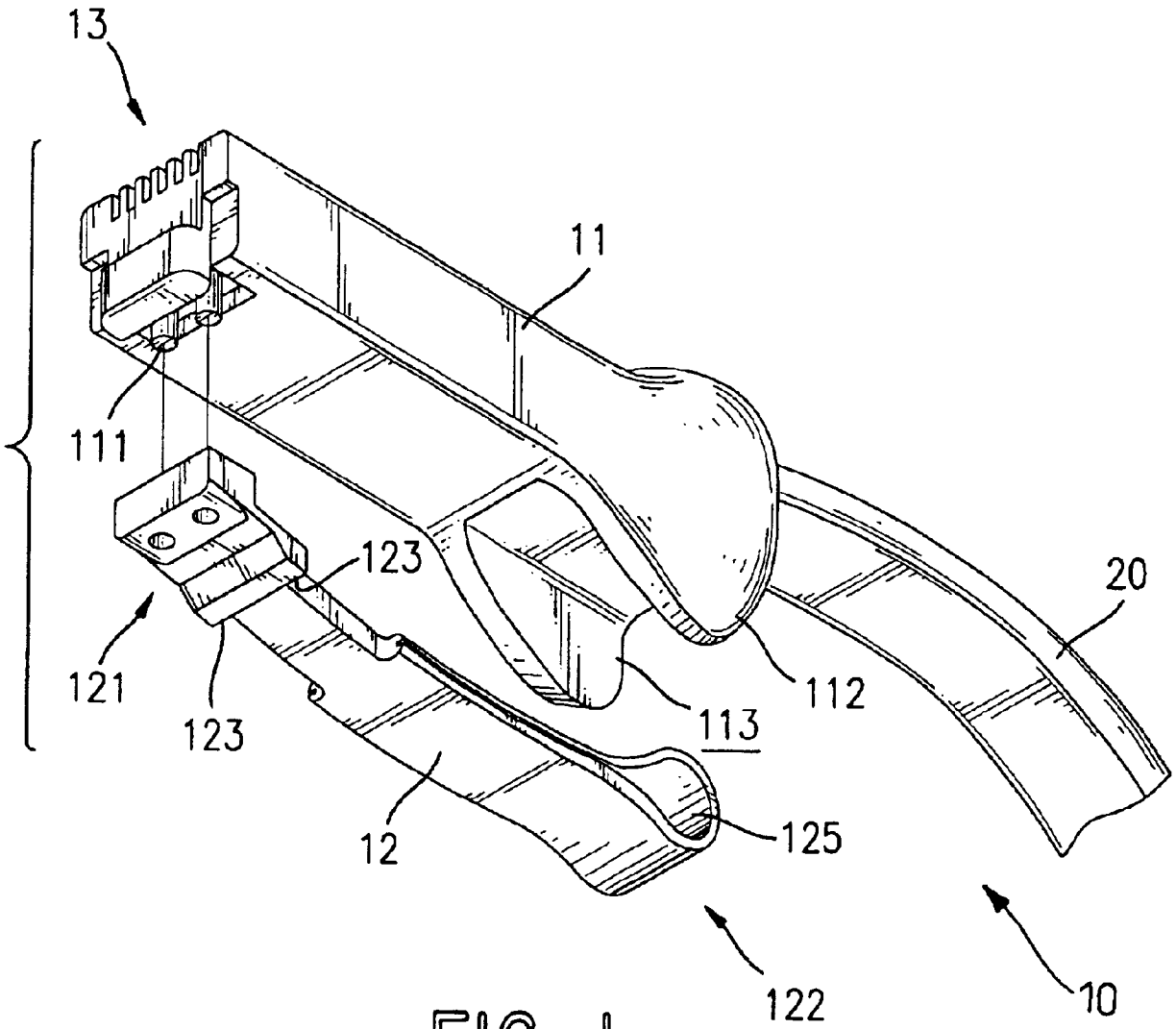
FIG. 1 is an exploded perspective view of a modular telephone plug in accordance with the present invention.
Figure 2:
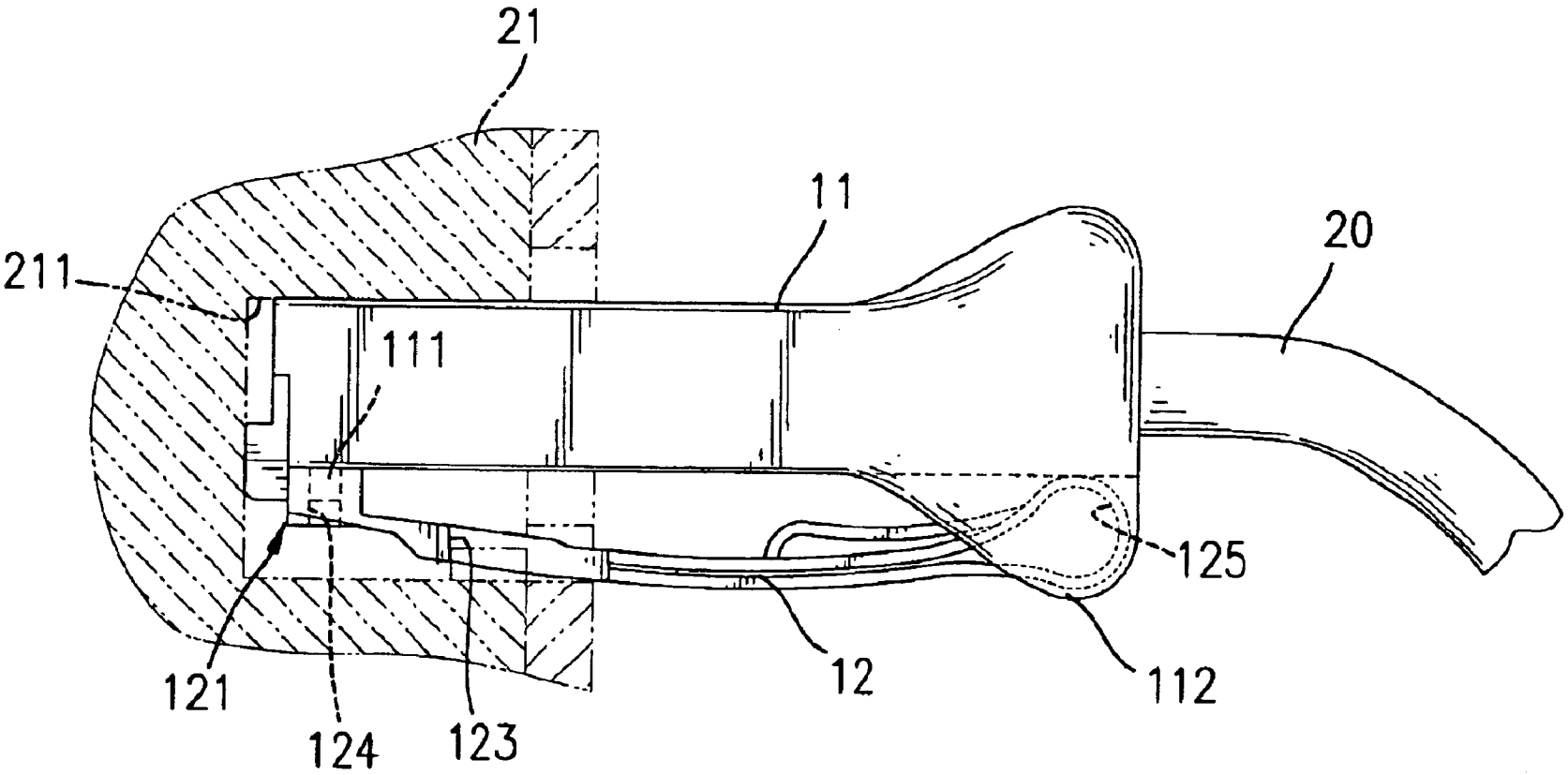
FIG. 2 is an operational side plan view of the modular telephone plug when the plug is held in a jack hole.

With reference to FIGS. 1 and 2, a modular telephone plug (10) in accordance with the present invention is adapted to be inserted into a jack hole (211) of a socket (21) and connect a telephone cord (20) to the socket (21) that might be mounted either in a telephone (not shown) or on a wall (not shown) as; previously described. The telephone plug (10) comprises an elongated housing (11), an engaging tab (12) and a connector module (13) that is fabricated in a conventional manner and a person skilled in this art will recognize that a detailed description to the connector module (13) is not necessary to be further provided.

The elongated housing (11) has an inside end (not numbered), an outside end (not numbered), a top (not numbered), a bottom (not numbered), a coupling device, such as two stubs (111) formed on and protruded from the bottom, and two wings (112). The inside end is adapted to be inserted into the jack hole (211). The outside end is adapted for the telephone line (20) passing into the elongated housing (11) to connect electrically to the connector module (13). The connector module (13) is mounted in the elongated housing (11) at the inside side for establishing an electrical connection between the socket (21) and the telephone cord (20). The wings (112) are respectively formed integrally at the outside end of the housing (11) and are separated from each other to form a passage (13) between the wings (112).

The engaging tab (12) is curved, is made of flexible material and is attached to and held on the bottom of the elongated housing (11) by means of the coupling device. The engaging tab (12) is kept with a gap (not numbered) between the bottom of the elongated housing (11) and itself because of its curvature, and the engaging tab (12) has a stationary end (121), a free end (122), two sides (not numbered) and two opposite detents (123). Me stationary end (121) has two holes (124) corresponding to the stubs (111), thus the stubs, (111) are inserted and held in the holes (124) to mount the engaging tab (12) on the bottom of the elongated housing (11).

The free end (122) of the engaging tab (12) abuts slidably on the bottom at the outside end of the elongated housing (11) and can be formed as a loop (125) that slidably held in the passage (113) between two wings (112). Thus, the wings (112) protect the loop (125) from being pressed inadvertently and hooking inadvertently something.

The two detents (123) are defined respectively at the sides adjacent to the inner end (121) and correspond to the gap between the engaging tab (12) and the bottom of the elongated housing (11). The detents (123) are adapted to engage the jack hole (211) to hold the telephone plug (10) in position when the telephone plug (10) has been inserted in the jack hole (211) as previously described.

Figure 3:
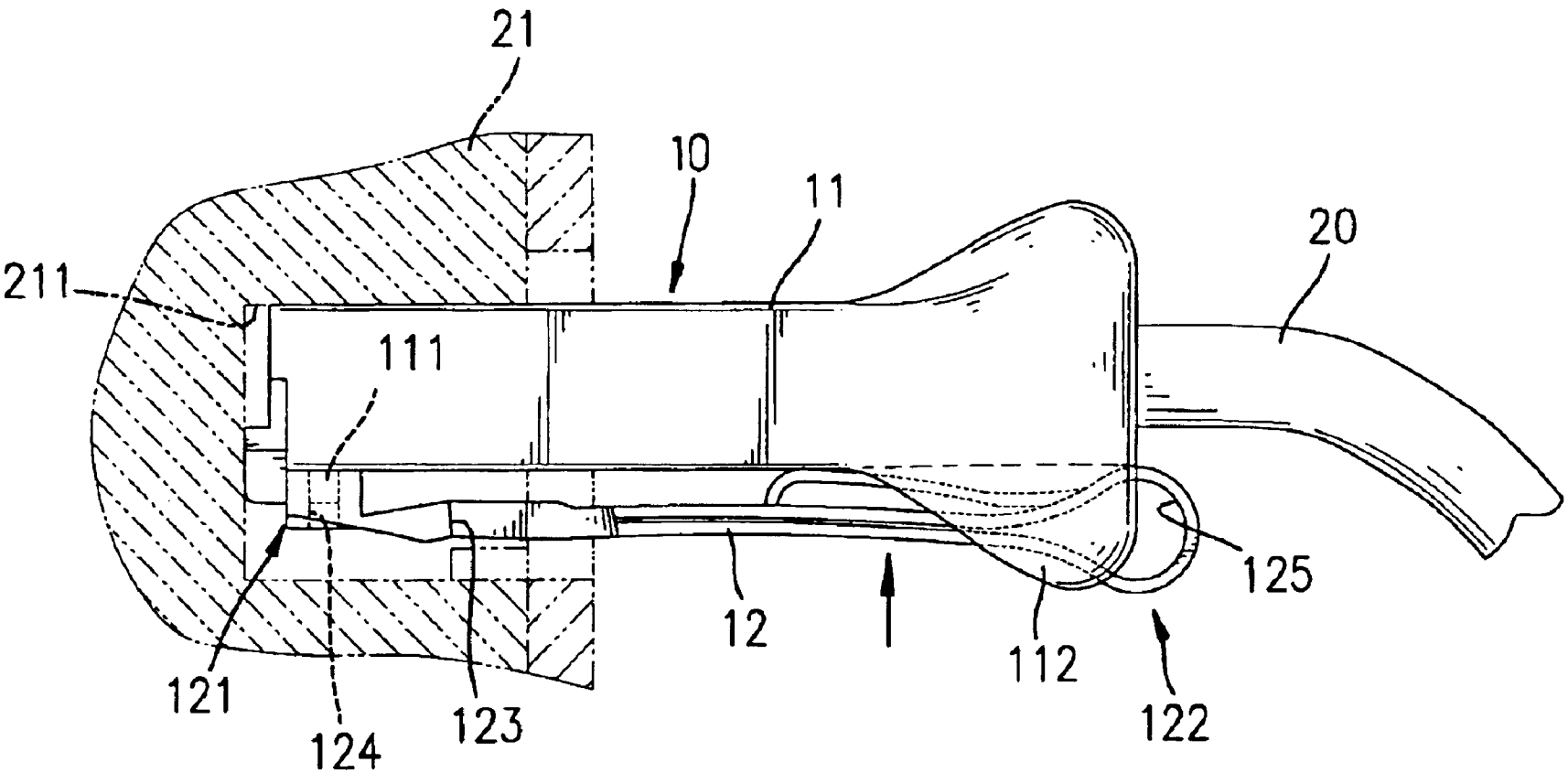
FIG. 3 is an operational side plan view of the modular telephone plug in FIG. 2 when an engaging tab is pressed so as to pull the plug out.

With reference to FIG. 3, when the telephone plug (10) is held in the jack hole (211), a person then needs to pull out the telephone plug (10), whereafter the person can press the engaging tab (11) at a position indicated by an arrow indicated near to the outside end (122). The loop (125) will slide outwardly on the bottom of the elongated housing (11) so that the engaging tab (11) is simultaneously deformed to reduce the gap, thus the detents (123) disengage from the jack hole (211). Then, the person can conveniently grasp the elongated housing (11) and quickly pull out the telephone plug (10) without any problems as the detents (123) have disengaged from the jack hole (211).

Figure 4:
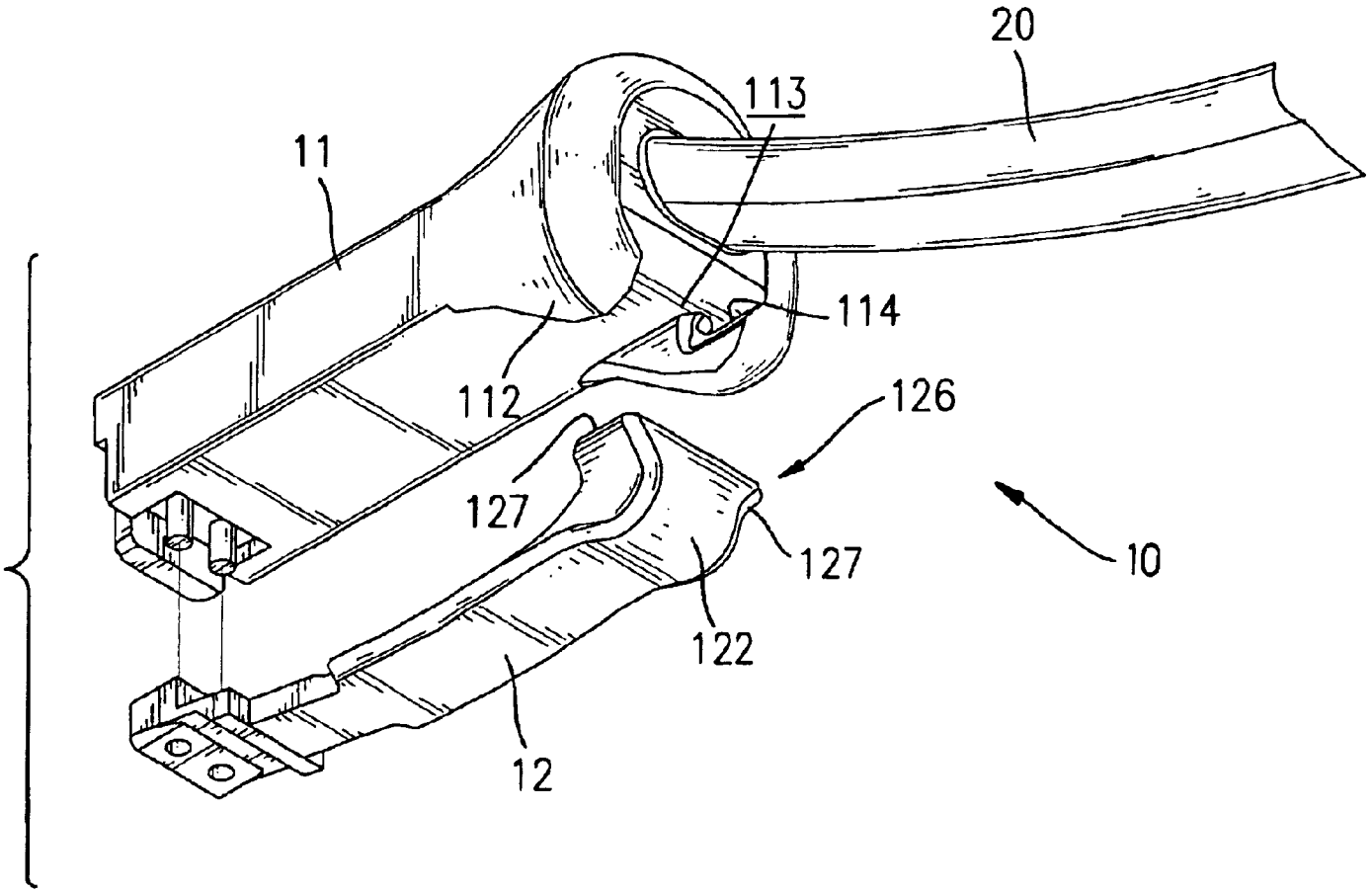
FIG. 4 is an exploded perspective view of a second embodiment of the present invention.
Figure 5:
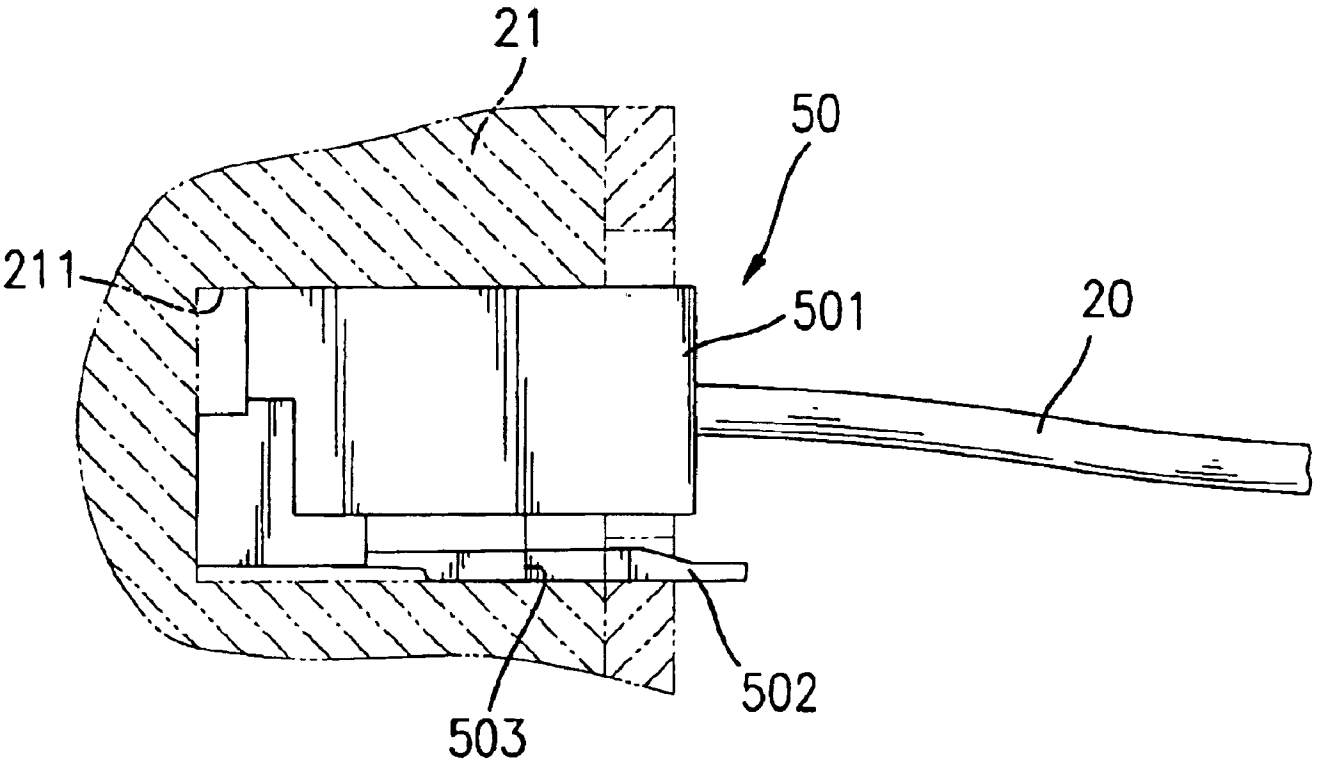
FIG. 5 PRIOR ART
FIG. 5 is an operational side plan view of a modular telephone plug in accordance with the prior art when the plug is held in the jack hole.
Figure 6:
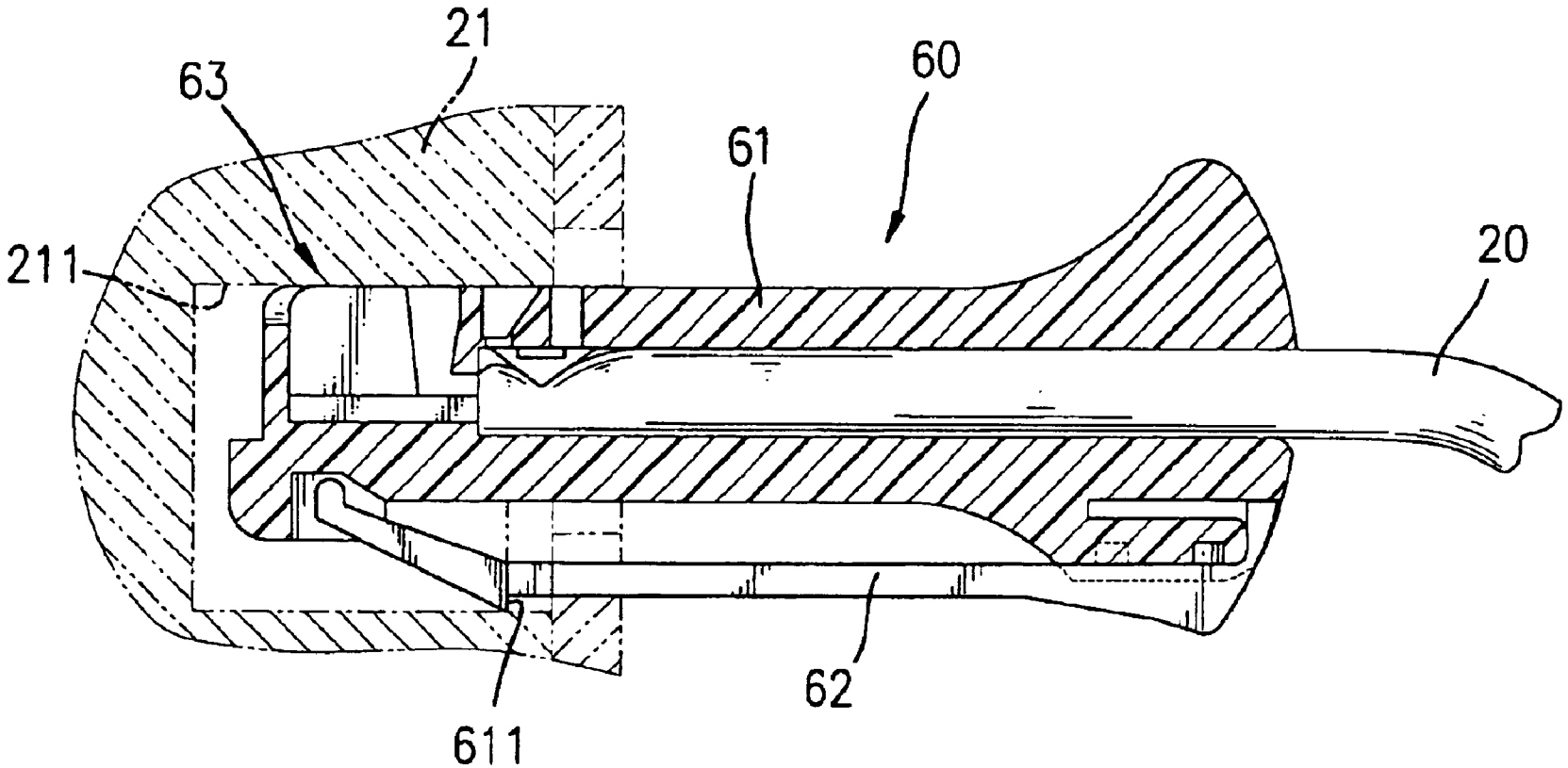
FIG. 6 PRIOR ART
FIG. 6 is an operational side plan view of another type of the modular telephone plug in accordance with the prior art when the plug is held in the jack hole.

With reference to FIG. 4, a second embodiment of the present invention is a modification of the aforesaid telephone plug (10). The elongated housing (11) is modified to further have two guiding grooves (114) respectively defined in the wings (112) in the passage (113). The free end (122) of the engaging tab (12) is modified as a sliding block (126) that has two opposite sides (not numbered) and two protrusions (127) formed respectively at the sides. The protrusions (127) are respectively mounted and slidably held in the guiding grooves (114) so as to allow the engaging tab (12) can be deformed.

Consequently, one end of the engaging tab (12) is fixed and the other end is protected by the wings (112) so that the engaging tab (12) is almost impossible to be broken inadvertently by the engaging tab (12) hooking something. Furthermore, the person can conveniently grasp the elongated housing (11) to pull out the telephone plug (10). Moreover, a person wearing gloves can easily access the engaging tab (12), and only a light force is needed to press the; engaging tab (12) to disengage the detents (123) from the jack hole (211).

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the scope of the appended claims.

What is claimed is:

1. A modular telephone plug comprising:

an elongated housing having an inside end, an outside end, a bottom and a coupling device formed on the bottom;

a connector module mounted in the elongated housing at the inside side; and a flexible engaging tab with two opposite sides mounted detachably on the bottom of the elongated housing, the flexible engaging tab defining a gap between the engaging tab and the bottom of the elongated housing and the engaging tab having a stationary end fastened on the bottom at the inside end of the elongated housing by the coupling device;

a free end abutting slidably on the bottom at the outside end of the elongated housing;

two detents defined respectively at the sides adjacent to the inner end and corresponding to the gap between the engaging tab and the bottom of the elongated housing, wherein the elongated housing further has two wings respectively formed integrally at the outside end of the housing and separated from each other and defining a passage between the wings, and two guiding grooves respectively defined in the wings in the passage; and the free end of the engaging tab is a sliding block having two opposite sides and two protrusions formed respectively at the sides, mounted respectively and held slidably in the guiding grooves.

2. The modular telephone plug as claimed in claim 1, wherein the coupling device is two stubs formed and protruded from the bottom of the elongated housing; and the stationary end of the engaging tab has two holes corresponding to the stubs;

wherein the stubs are inserted and held respectively in the holes to mount the engaged tab on the bottom of the elongated housing.

* * * * *